US007463232B2

(12) United States Patent
Lee et al.

(10) Patent No.: US 7,463,232 B2
(45) Date of Patent: Dec. 9, 2008

(54) THIN FILM TRANSISTOR LCD STRUCTURE AND DRIVING METHOD THEREOF

(75) Inventors: Yong-Ho Lee, Taoyuan Hsien (TW); Seob Shin, Taoyuan Hsien (TW); Po-Sheng Shih, Taoyuan Hsien (TW); Jia-Shyong Cheng, Hsinchu Hsien (TW)

(73) Assignee: Hannstar Display Corporation, Taipei (TW)

( * ) Notice: Subject to any disclaimer, the term of this patent is extended or adjusted under 35 U.S.C. 154(b) by 630 days.

(21) Appl. No.: 10/910,647

(22) Filed: Aug. 4, 2004

(65) Prior Publication Data

US 2005/0046620 A1 Mar. 3, 2005

(30) Foreign Application Priority Data

Sep. 1, 2003 (TW) ..... 92124138 A
Jan. 15, 2004 (TW) ..... 93101080 A

(51) Int. Cl.
*G09G 3/36* (2006.01)

(52) U.S. Cl. ..... 345/90; 345/87

(58) Field of Classification Search ..... 345/87–100; 349/43

See application file for complete search history.

(56) References Cited

U.S. PATENT DOCUMENTS

2002/0180899 A1* 12/2002 Lin et al. ..... 349/43
2003/0107544 A1* 6/2003 Edwards ..... 345/96
2003/0189537 A1* 10/2003 Yun ..... 345/87
2003/0193458 A1* 10/2003 Klein ..... 345/87

* cited by examiner

*Primary Examiner*—Amare Mengistu
*Assistant Examiner*—Jennifer Zubajlo
(74) *Attorney, Agent, or Firm*—Baker & Hostetler LLP

(57) ABSTRACT

The video data output from the dot-inversion driver is re-arranged in the present invention. According this re-arranged method, the video data output from the even data lines or odd data lines is delayed for one scan line scan time. Then, the re-arranged video data are applied to the liquid crystal display structure whose thin film transistors connected with the same scan line are arranged in alternatingly up-down form to store row-inversion driving data in the pixel region.

8 Claims, 11 Drawing Sheets

| | | | | | |
|---|---|---|---|---|---|
| + | + | + | + | + | + |
| − | − | − | − | − | − |
| + | + | + | + | + | + |
| − | − | − | − | − | − |
| + | + | + | + | + | − |

Fig. 2 (PRIOR ART)

| | | | | | |
|---|---|---|---|---|---|
| + | − | + | − | + | − |
| + | − | + | − | + | − |
| + | − | + | − | + | − |
| + | − | + | − | + | − |
| + | − | + | − | + | − |

Fig. 3 (PRIOR ART)

| | | | | |
|---|---|---|---|---|
| + | − | + | − | + |
| − | + | − | + | − |
| + | − | + | − | + |
| − | + | − | + | − |
| + | − | + | − | + |

Fig. 4 (PRIOR ART)

| | $D_1$ | $D_2$ | $D_3$ | $D_4$ | $D_5$ | $D_6$ | $D_7$ | $D_8$ | ... | $D_n$ |
|---|---|---|---|---|---|---|---|---|---|---|
| first scan line scan time | + $R_{11}$ | | + $B_{11}$ | | + $G_{12}$ | | + $R_{13}$ | | | |
| second scan line scan time | − $R_{21}$ | + $G_{11}$ | − $B_{21}$ | + $R_{12}$ | − $G_{22}$ | + $B_{12}$ | − $R_{23}$ | | | |
| third scan line scan time | + $R_{31}$ | − $G_{21}$ | + $B_{31}$ | − $R_{22}$ | + $G_{32}$ | − $B_{22}$ | + $R_{33}$ | | | |
| fourth scan line scan time | − $R_{41}$ | + $G_{31}$ | − $B_{41}$ | + $R_{32}$ | − $G_{42}$ | + $B_{32}$ | − $R_{43}$ | | | |

Fig. 8

THIN FILM TRANSISTOR LCD STRUCTURE AND DRIVING METHOD THEREOF

FIELD OF THE INVENTION

The present invention relates to a driving method and more particularly to a driving method for driving a liquid crystal display.

BACKGROUND OF THE INVENTION

In general, as shown in FIG. 1, a liquid crystal display panel is composed of the cross-connected data lines (D1, D2, D3, . . . Dy) and the scan lines (G1, G2, . . . Gx). Each data and scan line pair can be used to control a display cell. For example, data line D1 and scan line G1 can be used to control the display cell 100. As shown in FIG. 1, the equivalent circuit of display cell 100 (the same for other display cells) includes a thin film transistor 10 for control, a storage capacitor Cs and a liquid crystal capacitor Clc constructed by the display electrode and the common electrode. The gate and the drain of the thin film transistor 10 are connected to scan line G1 and data line D1, respectively. The video signal carried by the data line D1 can be written to the display cell 100 by controlling the conducting state of the thin film transistor 10 according to the scan signal carried by the scan line G1.

Scan driver 30 sends out the scan signal on the scan line G1, G2, . . . Gx sequentially, according to scan control signals. When one of the scan lines is scanned, the thin film transistors corresponding to this scanned line are turned on and the thin film transistors corresponding to other scan lines are turned off. When the thin film transistors of the display cells in a row are turned on, data driver 20 sends a corresponding video signal (gray level) to data lines D1, D2, and Dy. When scan driver 30 finishes scanning the scan lines, the display of a single video frame is done. The scanning of the scan lines described above is performed repeatedly, thereby displaying subsequent video frames.

To prevent the liquid crystal molecules from being subjected to a voltage bias of single polarity and therefore shortening the life of the liquid crystal molecules, a single display cell in the general TFT-LCD is driven by video signals of opposite polarities in the odd-numbered video frames and even-numbered video frames. There are four driving schemes that achieve the above-described requirement, including frame inversion, row inversion, column-inversion and dot-inversion.

In the row inversion, as shown in FIG. 2, the polarity of voltage applied to the pixel electrodes is reversed at every scan line (row). In the column inversion, as shown in FIG. 3, the polarity of voltage applied to the pixel electrodes is reversed at every data line (column). In the dot inversion method, as shown in FIG. 4, the polarity of voltage is reversed at adjacent scan lines or data lines.

In the row and column inversion method, a flicker problem occurs. The reason is given as follows. When a scan line signal is "HIGH," all the TFTs connected to the scan line are turned on, and the video signals are sent to the pixel electrodes from the drain electrodes connected to the data lines. Then, the liquid crystal is driven by the voltage difference between the pixel electrode and the common electrode. When the scan line signal is "LOW", all the TFTs connected to the scan line are turned off. At that time, the voltage of the video signal applied to the pixel electrodes remains in the pixel electrode, and the display image is maintained. However, the stored voltage in the pixel electrode is reduced by $\Delta V$ by coupling capacitors (Cgs), which are formed between the scan lines and data lines. Since the voltage in the pixel electrodes is not constant, the display has a flicker problem.

Although the dot-inversion method can reduce the flicker problem, this method has to use a constant common voltage. In other words, the common voltage, such as 0 volt, and two opposing voltages, such as +2 volt and −2 volt, are used to form a positive polarity and a negative polarity for the same gray level so that it is possible to output a voltage two times greater than the row inversion driving process. Moreover, a larger driver area is required in the dot-inversion method. As a result, this dot-inversion driving method causes an increase in the cost of a driver and larger power consumption than with the row inversion driving system.

SUMMARY OF THE INVENTION

Therefore, it is the main object of the present invention to provide a liquid crystal display structure and driving method thereof capable of obtaining a display result of row-inversion driving method by using a dot-inversion driving method, which can avoid the flicker problem. Similarly, the present invention is able to obtain a display result of dot-inversion driving method by using a row-inversion driving method, which can reduce the power consumption.

The present invention provides a driving method for driving a liquid crystal display, which is capable of obtaining a display result of the row-inversion driving method by using a dot-inversion driver. The video data output from the dot-inversion driver is re-arranged in the present invention. According to this re-arranged method, the video data output from the even-numbered data lines or odd-numbered data lines is held for one scan line scan time. Then, the re-arranged video data is applied to the liquid crystal display structure, whose thin film transistors connected with the same scan line are arranged in alternatingly up-down form to store row-inversion driving data in the pixel region.

The present invention provides a driving method for driving a liquid crystal display, which is capable of obtaining a display result of the dot-inversion driving method by using a row-inversion driver. The video data output from the row-inversion driver is re-arranged in the present invention. According to this re-arranged method, the video data output from the even-numbered data lines or odd-numbered data lines is held for one scan line scan time. Then the re-arranged video data is applied to the liquid crystal display structure whose thin film transistors connected with the same scan line are arranged in alternatingly up-down form to store dot-inversion driving data in the pixel region.

The present invention provides a liquid crystal display structure. In accordance with this structure, a plurality of data lines is arranged parallel to each other and crossed with the scan lines. A plurality of thin film transistors is formed at the intersections of the scan lines and the data lines. The pixel regions are in the area surrounded by the neighboring scan lines and data lines. According to the structure, the any two adjacent thin film transistors connected with the same scan line are arranged in alternatingly up-down form. One thin film transistor is disposed on the upper side and the other on the lower side of the scan line.

BRIEF DESCRIPTION OF THE DRAWINGS

The foregoing aspects and many of the attendant advantages of this invention will become more readily appreciated and better understood by referencing the following detailed description, when taken in conjunction with the accompanying drawings, wherein:

FIG. 2 illustrates the pattern of the polarities of the video signals in the conventional line-inversion driving scheme;

FIG. 3 illustrates the pattern of the polarities of the video signals in the conventional column-inversion driving scheme;

FIG. 4 illustrates the pattern of the polarities of the video signals in the conventional dot-inversion driving scheme;

FIG. 8 illustrates the relationship between the data sent out from the dot-inversion driver and the scan time of the scan line;

DETAILED DESCRIPTION OF THE PREFERRED EMBODIMENT

Without limiting the spirit and scope of the present invention, the circuit structure proposed in the present invention is illustrated with one preferred embodiment. One with ordinary skill in the art, upon acknowledging the embodiment, can apply the liquid crystal display driving method of the present invention to various liquid crystal displays. According to the first embodiment, a display result of row-inversion driving method can be obtained by using a dot-inversion driving method without using the row-inversion driver. According to the second embodiment, a display result of dot-inversion driving method can be obtained by using a row-inversion driving method without using the dot-inversion driver. The application of the present invention is not limited by the preferred embodiments described in the following.

Figure 5:
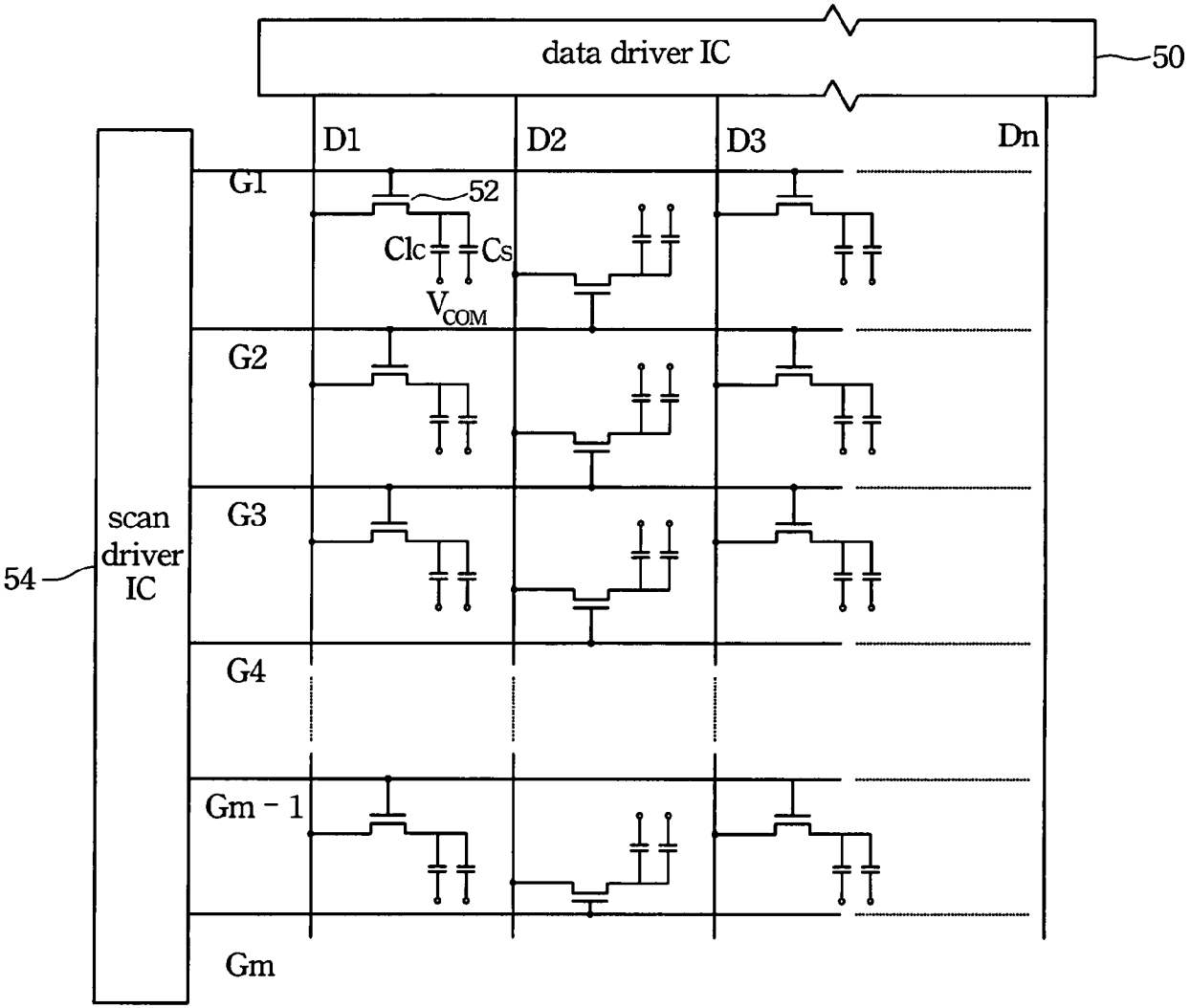
FIG. 5 illustrates a schematic diagram of an equivalent circuit of the present invention thin-film transistor liquid crystal display device.

Referring to FIG. 5, a schematic diagram of an equivalent circuit of the present invention thin-film transistor liquid crystal display device is illustrated. The liquid crystal display of the present invention is composed of the cross-connected data lines (D1, D2, D3, . . . Dn) and the scan lines (G1, G2, . . . Gm). The data lines and the scan lines perpendicularly cross each other. Each of the area surrounded by the neighboring scan lines and data lines is called a pixel. A storage capacitor Cs and a liquid crystal capacitor Clc constructed by the display electrode and the common electrode are formed in a pixel region. The thin film transistor 52 is formed at each data line and scan line intersection. A data driver IC 50 controls the data lines (D1, D2, D3, . . . Dn). A scan driver IC 54 controls the scan lines (G1, G2, . . . Gm).

The thin film transistor in each pixel region includes a gate electrode, a source electrode and a drain electrode. The gate electrode is connected to the scan line, the source electrode is connected to the data line, and the drain electrode is connected to the storage capacitor Cs and a liquid crystal capacitor Clc. The thin film transistor works as a switch for passing a data voltage of the data line to the drain electrode when a scan voltage is applied to the gate electrode through the scan line. The data voltage is then applied to the storage capacitor Cs and a liquid crystal capacitor Clc from the drain electrode. Video data are applied from the data driver IC 50 to the data lines (D1, D2, D3, . . . Dn). The video data include grey scaled data of red (R), green (G), and blue (B), which are applied to the corresponding pixel electrodes. Moreover, the gate electrodes of the thin film transistors whose source electrodes are connected to the odd-numbered data lines are respectively connected to the scan lines G1, G2, . . . $G_{m-1}$. The gate electrodes of the thin film transistors, whose source electrodes are connected to the even-numbered data lines, are respectively connected to the scan lines G2, G3, . . . $G_m$. For example, the gate electrodes of these thin film transistors whose source electrodes are connected to the data line D1 are respectively connected to the scan lines G1, G2, . . . $G_{m-1}$. The gate electrodes of the thin film transistors whose source electrodes are connected to the data line D2 are respectively connected to the scan lines G2, G3, . . . $G_m$.

First Embodiment

Figure 1:
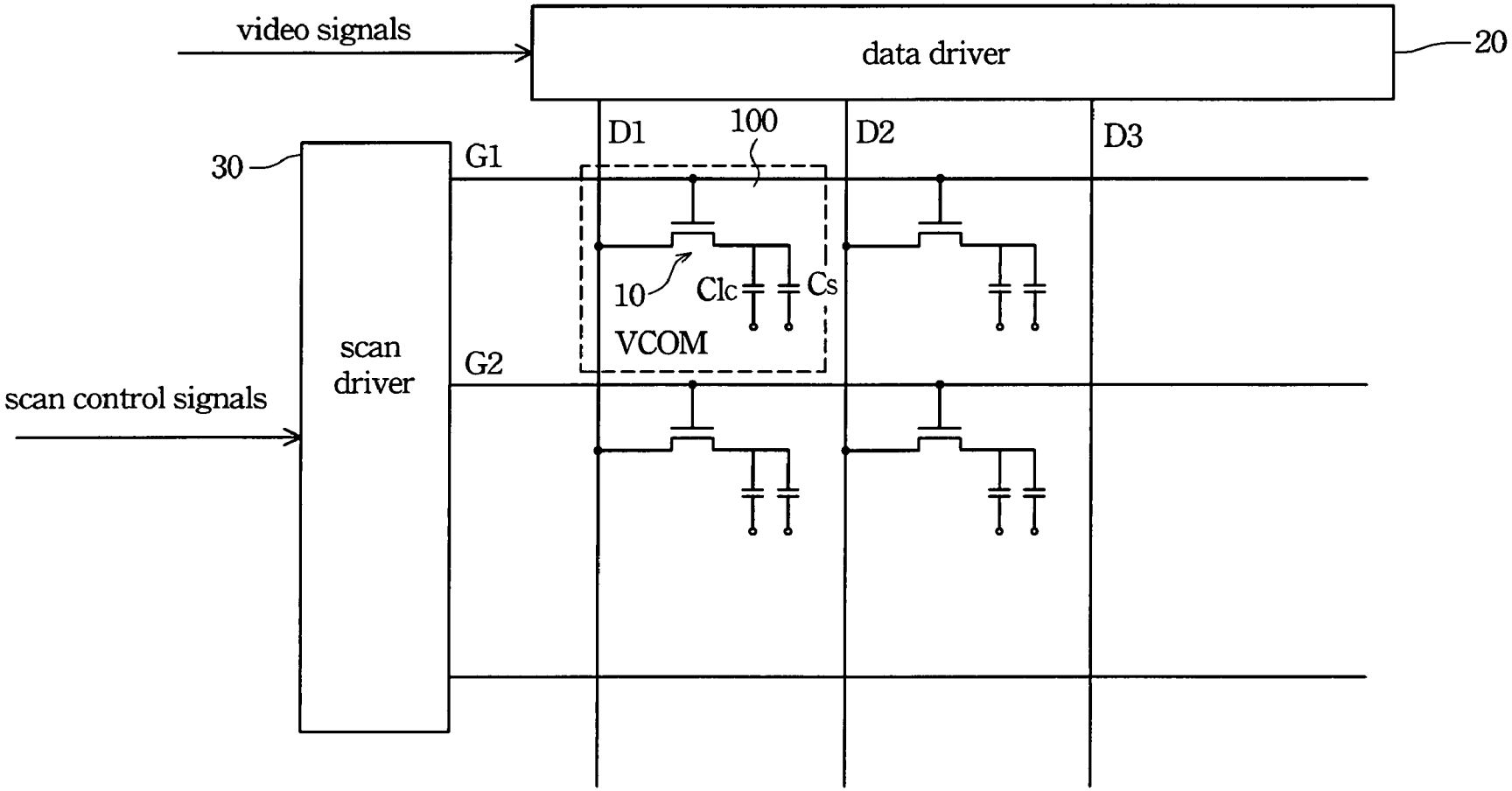
Fig. 1 (PRIOR ART)
FIG. 1 illustrates a schematic diagram of an equivalent circuit of the conventional thin-film transistor liquid crystal display device.
Figure 6:
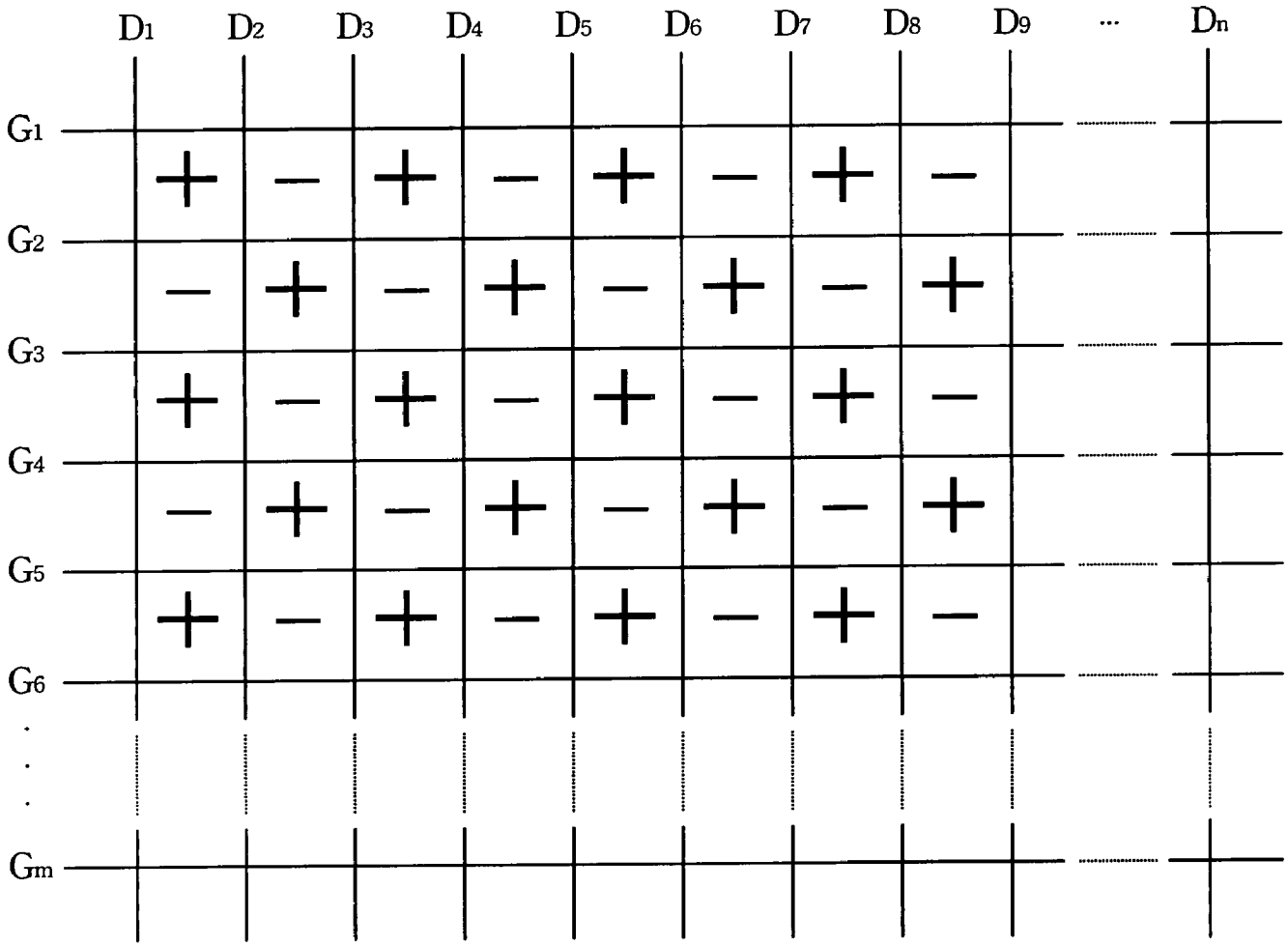
FIG. 6 illustrates the pattern of the polarities of the video signals in the pixel regions when using the conventional dot-inversion driving method to drive the conventional thin-film transistor liquid crystal display device.

Referring to FIG. 6, the pattern of the polarities of the video signals in the pixel regions when using the conventional dot-inversion driving method to drive the conventional thin-film transistor liquid crystal display device (as shown in FIG. 1) is illustrated. Each of the areas surrounded by the neighboring scan lines and data lines is called a pixel.

According to the structure of FIG. 5, any two adjacent thin film transistors connected with the same scan line are arranged in alternatingly up-down form. One thin film transistor is disposed on the upper side and the other on the lower side of the scan line. In other words, these thin film transistors formed at the intersections of each scan line and the data lines (D1, D2, D3, . . . Dn) are arranged in alternatingly up-down form along connected scan line. These thin film transistors formed at the intersections of each data line and the scan lines (G1, G2 . . . $G_m$) are arranged in the same direction along the data line.

Figure 7:
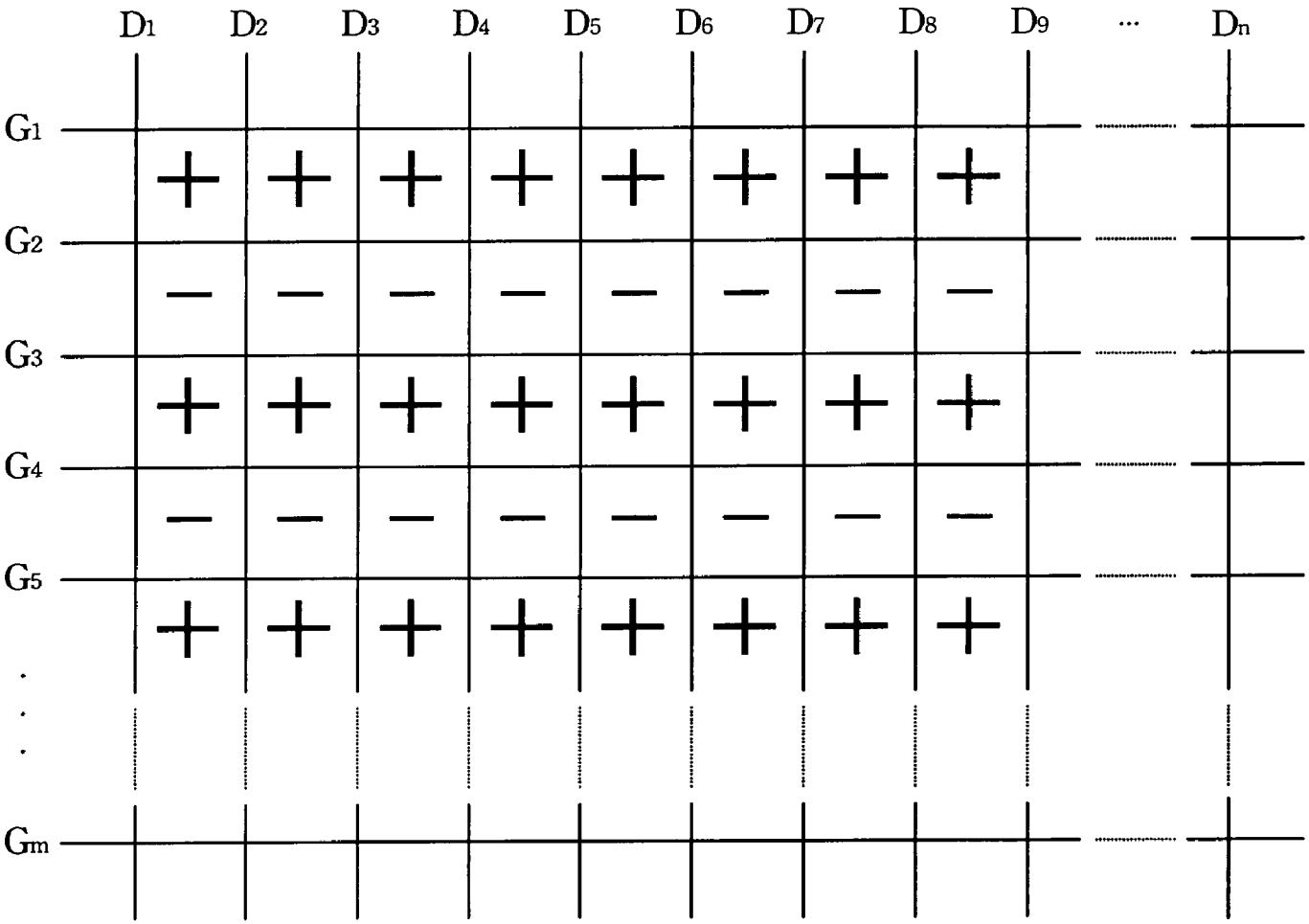
FIG. 7 illustrates the pattern of the polarities of the video signals in the pixel regions when using the conventional dot-inversion driving method to drive the present invention thin-film transistor liquid crystal display device.

According to the structure of FIG. 5, in any two adjacent pixel regions, the two thin film transistors are controlled by two adjacent scan lines. In other words, the two thin film transistors are not turned on at the same time. Therefore, when using the conventional dot-inversion driving method to drive the thin-film transistor liquid crystal display device of the present inveniton, the polarities pattern is as shown in FIG. 7, with the polarity of voltage is reversed at every row. In other words, a row-inversion display result can be obtained when using a conventional dot-inversion driver IC to drive the present invention thin-film transistor liquid crystal display device.

Figure 9:
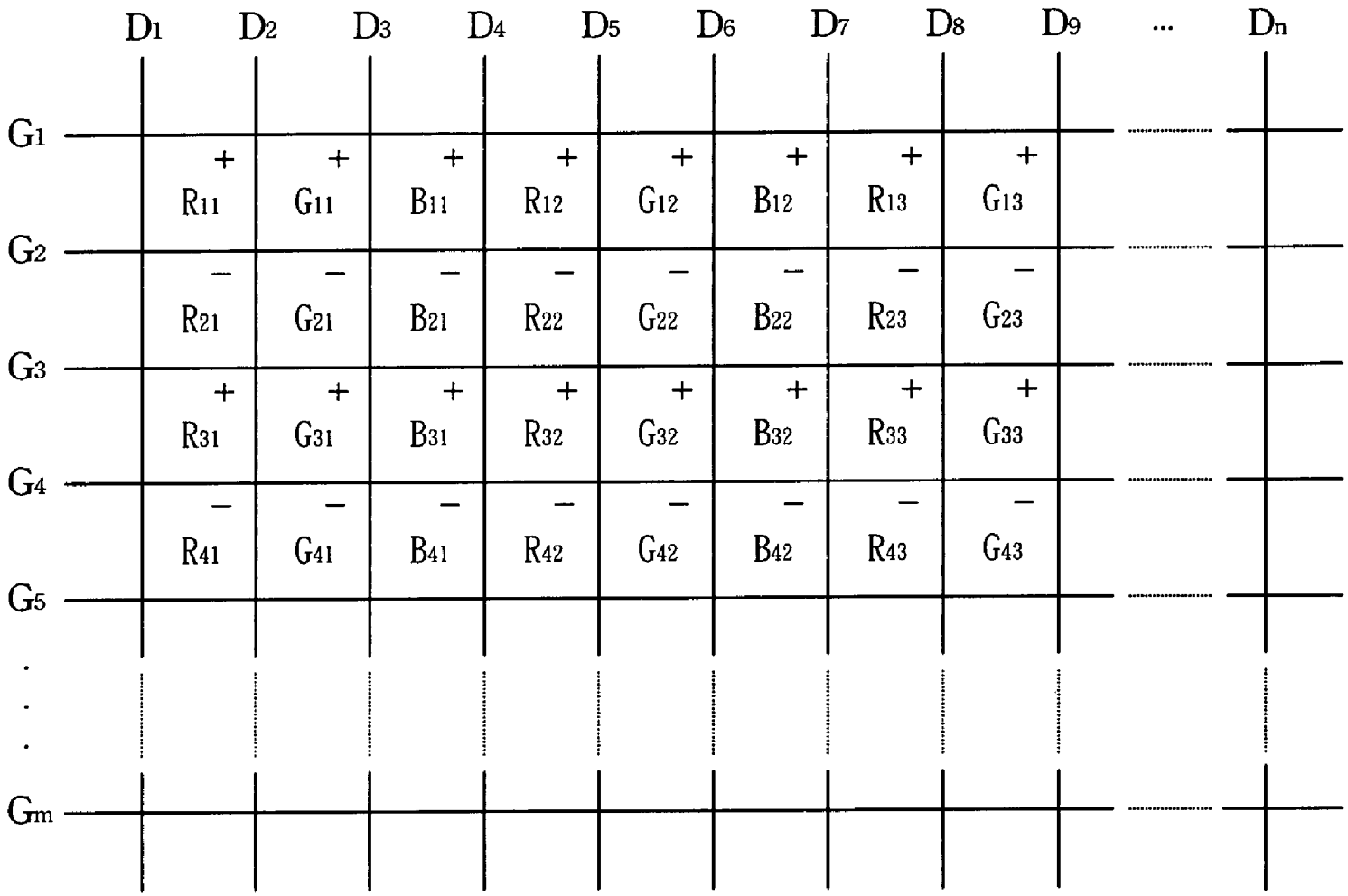
FIG. 9 illustrates the data stored in the pixel regions when using the video signals illustrated in FIG. 8 to drive the present invention thin-film transistor liquid crystal display device.

Typically, a plurality of groups consisting of red (R), green (G) and blue (B) color is used for the color liquid crystal display. Therefore, three pixel form a display unit. In the present invention, the first display unit is composed of three pixels connected with the data lines D1, D2 and D3. The second display unit is composed of three pixels connected with the data lines D4, D5 and D6. The rest may be deduced by analogy. According to the liquid crystal display structure in FIG. 5, the arrangement of the pixel regions controlled by each scan line is in alternatingly up-down form. Therefore, the data sent out by the dot-inversion driver IC need to be modulated to display the image as shown in FIG. 9.

FIG. 8 illustrates the relationship between the data sent out from the dot-inversion driver and the scan time of the scan line and the pattern of the video signals from the data lines when using the dot-inversion method to drive the present invention thin-film transistor liquid crystal display device. The data of the pixels defined by the even-numbered data lines D2, D4, D6 . . . and the scan lines G2, G3 . . . $G_m$ are held one scanning time of a scan line. For example, at the scanning time of the second scan line, originally, the data line D2 should transfer the video data $G_{21}$ of the pixel of the first display unit defined by the scan line G2 and the data line D2. However, according to the present invention, the data line D2 transfers the video data $G_{11}$ of the pixel of the first display unit defined by the scan line G1 and the data line D2. The data lines D1 and D3 still transfer the video data $R_{21}$ and $B_{21}$ of the pixel of the first display unit defined by the scan line G2 and the data line D1, D3. Similarly, the data line D4 should transfer the video data $R_{22}$ of the pixel of the second display unit defined by the scan line G2 and the data line D4, originally. However, according to the present invention, the data line D4 transfers the video data $R_{12}$ of the pixel of the second display unit defined by the scan line G1 and the data line D4. The data line D5 transfers the video data $G_{22}$ of the pixel of the second display unit defined by the scan line G2 and the data line D5. The data line D6 transfers the video data $B_{12}$ of the pixel of the second display unit defined by the scan line G1 and the data line D6. The rest may be deduced by analogy.

According to the present invention, the data sent out from the dot-inversion driver are changed to the pattern as shown in FIG. 8. Moreover, the changed data are applied to the liquid crystal display structure of the present invention as shown in FIG. 5. According to the liquid crystal display structure of FIG. 5, the thin film transistors formed at the intersections of each scan line and the data lines (D1, D2, D3, . . . Dn) are arranged in alternatingly up-down form along connected scan line. Therefore, when using the dot-inversion driver to drive the thin-film transistor liquid crystal display device of the present invention, the data is stored in the pixel regions in an alternatingly up-down form. Therefore, a correct image can be displayed in the liquid crystal display as shown in FIG. 9. Additionally, the video data as shown in FIG. 8 are driven by the dot-inversion method. However, a display result of row-inversion driving method as shown in FIG. 7 is displayed.

Accordingly, a display result of the row-inversion driving method using a dot-inversion driving method is obtained. The present invention avoids the horizontal cross-talk problem of the row-inversion method.

Second Embodiment

Figure 10:
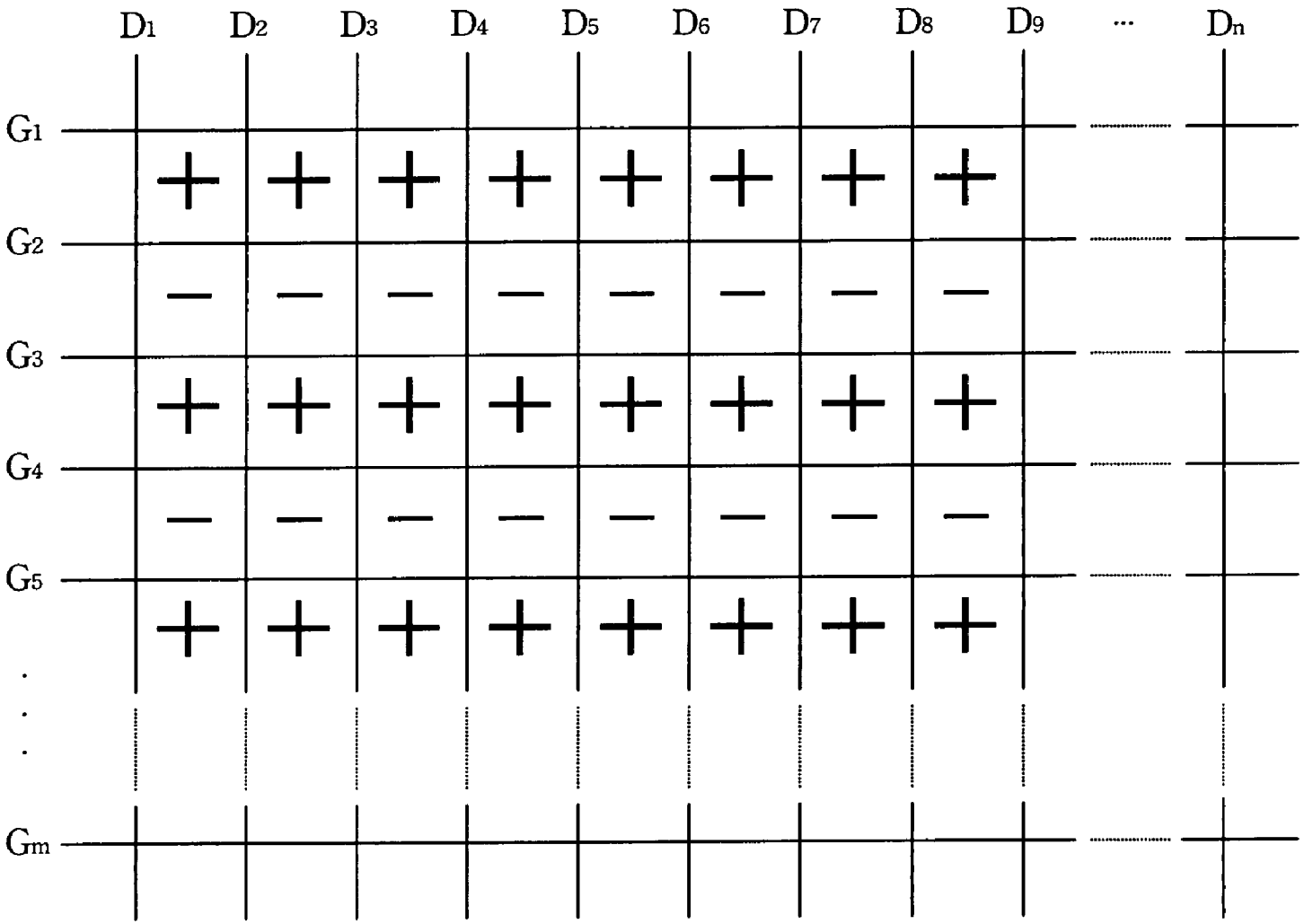
FIG. 10 illustrates the pattern of the polarities of the video signals in the pixel regions when using the conventional row-inversion driving method to drive the conventional thin-film transistor liquid crystal display device.

Referring to FIG. 10, the pattern of the polarities of the video signals in the pixel regions when using the conventional row-inversion driving method to drive the conventional thin-film transistor liquid crystal display device (as shown in FIG. 1) is illustrated. Each of the areas surrounded by the neighboring scan lines and data lines is called a pixel.

According to the structure of FIG. 5, any two adjacent thin film transistors connected with the same scan line are arranged in alternatingly up-down form. One thin film transistor is disposed on the upper side and the other on the lower side of the scan line. In other words, these thin film transistors formed at the intersections of each scan line and the data lines (D1, D2, D3, . . . Dn) are arranged in alternatingly up-down form along connected scan line. These thin film transistors formed at the intersections of each data line and the scan lines (G1, G2, . . . $G_m$) are arranged in the same direction along the data line.

Figure 11:
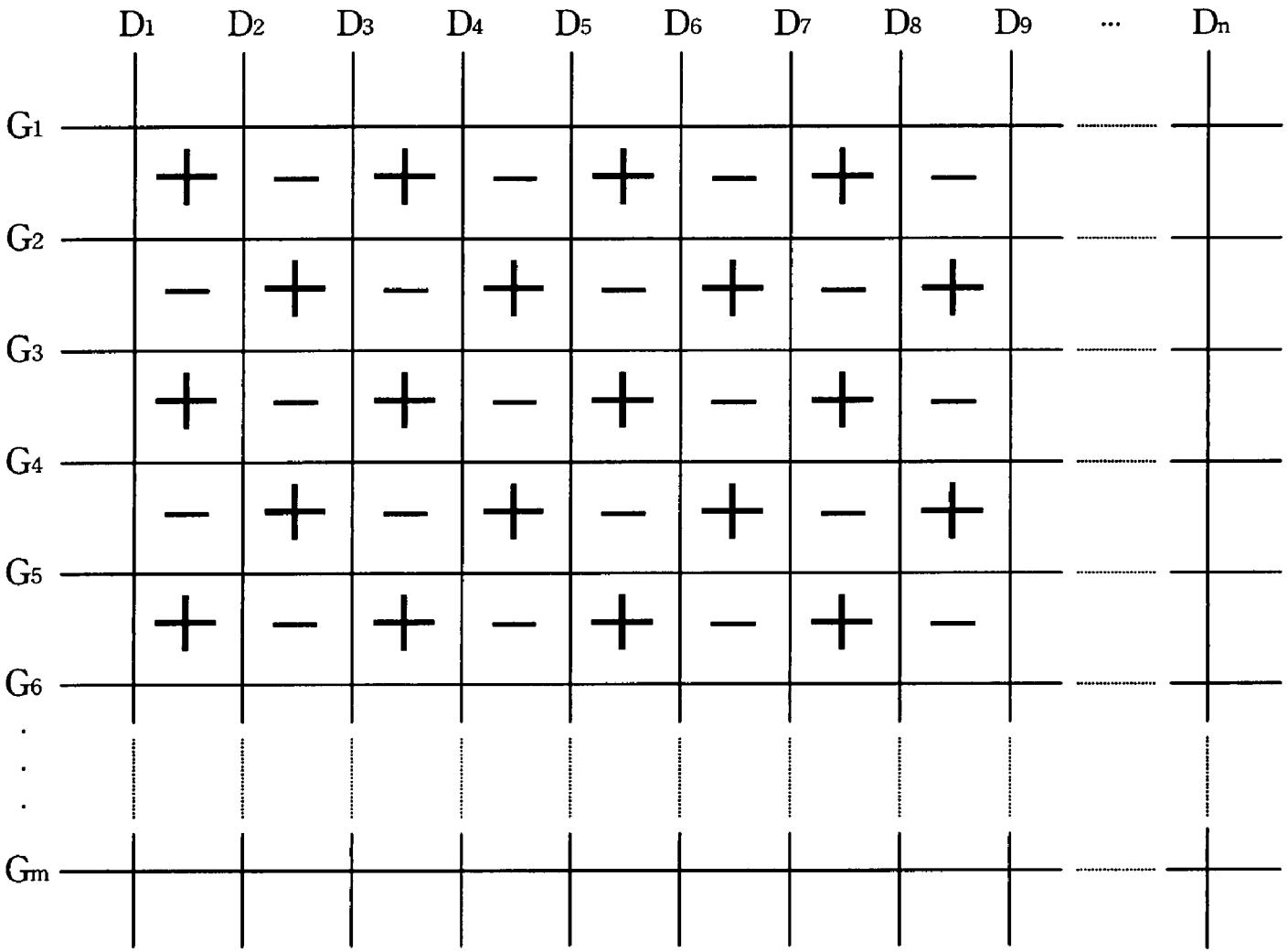
FIG. 11 illustrates the pattern of the polarities of the video signals in the pixel regions when using the conventional row-inversion driving method to drive the present invention thin-film transistor liquid crystal display device.

According to the structure of FIG. 5, in any two adjacent pixel regions, the two thin film transistors are controlled by two adjacent scan lines. In other words, the two thin film transistors are not turned on at the same time. Therefore, when using the conventional row-inversion driving method to drive the thin-film transistor liquid crystal display device of the present invention, the polarities pattern is as shown in FIG. 11, with the polarity of voltage reversed at every row and every column. In other words, a dot-inversion display result can be obtained when using a conventional row-inversion driver IC to drive the present invention thin-film transistor liquid crystal display device.

Figure 13:
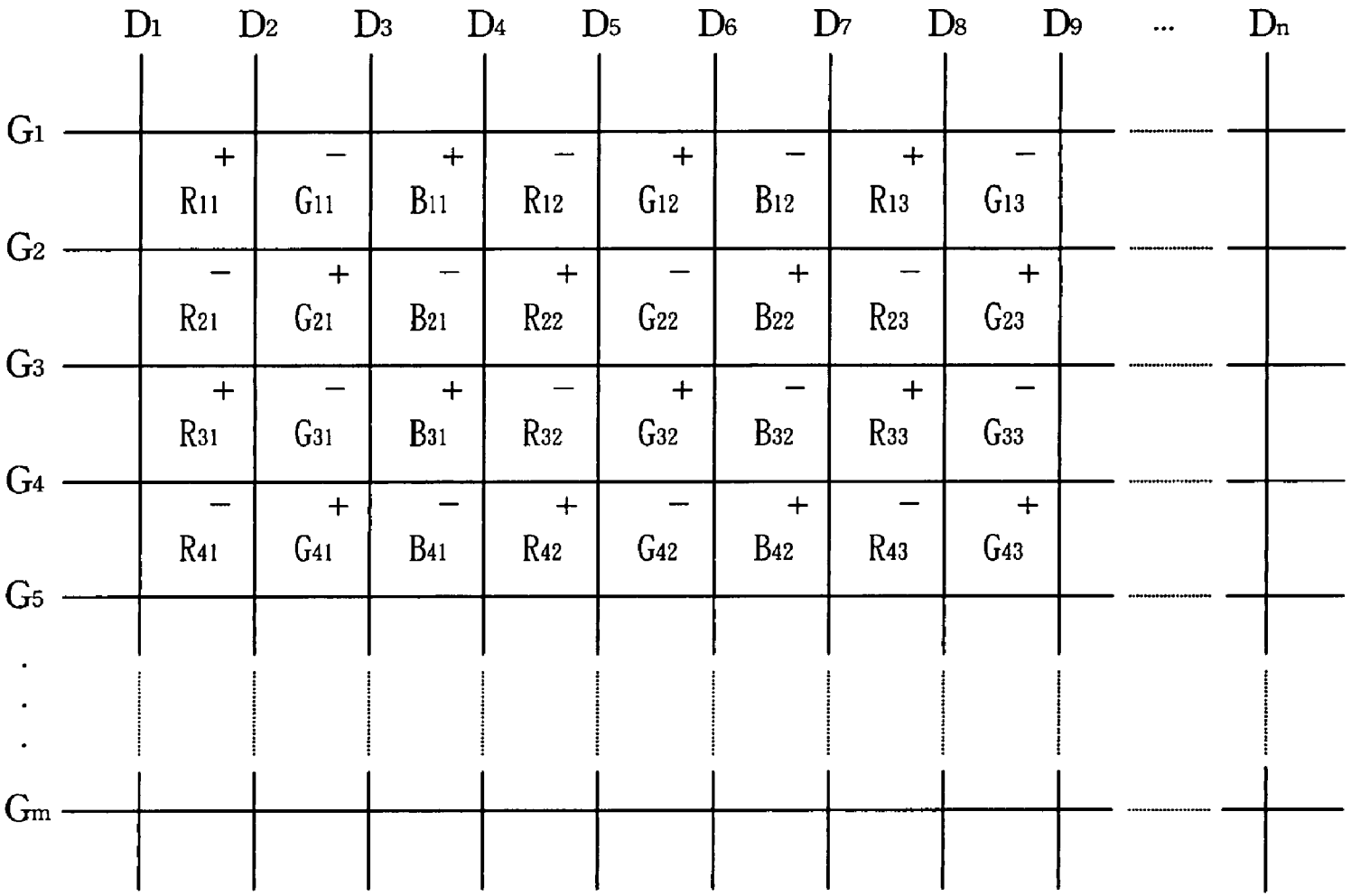
FIG. 13 illustrates the data stored in the pixel regions when using the video signals illustrated in FIG. 12 to drive the present invention thin-film transistor liquid crystal display device.

Typically, a plurality of groups consisting of red (R), green (G) and blue (B) color is used for the color liquid crystal display. Therefore, three pixels form a display unit. In the present invention, the first display unit is composed of three pixels connected with the data lines D1, D2 and D3. The second display unit is composed of three pixels connected with the data lines D4, D5 and D6. The rest may be deduced by analogy. According to the liquid crystal display structure in FIG. 5, the arrangement of the pixel regions controlled by each scan line is in alternatingly up-down form. Therefore, the data sent out by the row-inversion driver IC need to be modulated to display the image as shown in FIG. 13.

Figure 12:
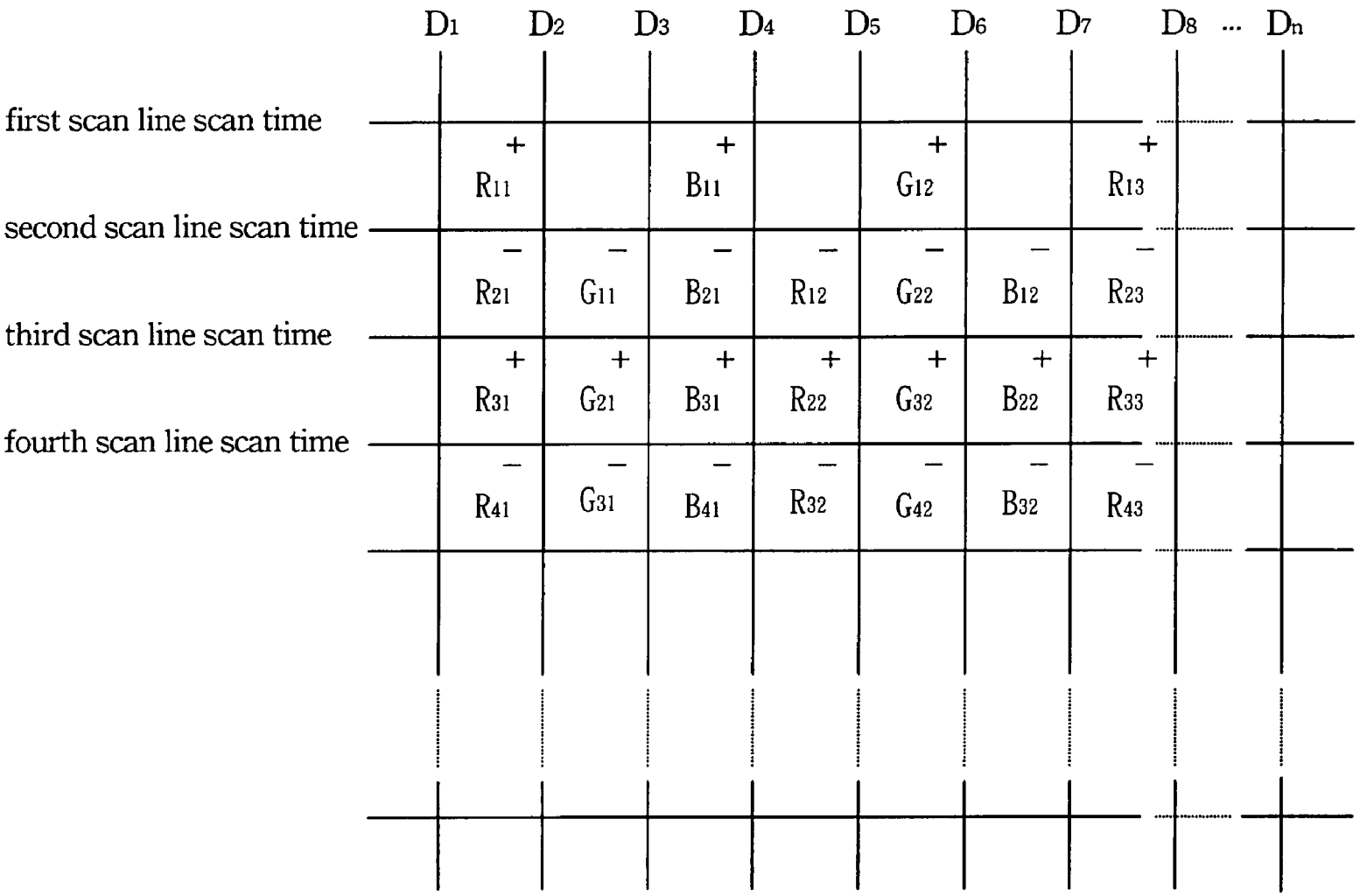
FIG. 12 illustrates the relationship between the data sent out from the row-inversion driver and the scan time of the scan line according to the present invention.

FIG. 12 illustrates the relationship between the data sent out from the row-inversion driver and the scan time of the scan line and the pattern of the video signals from the data lines when using the row-inversion method to drive the present invention thin-film transistor liquid crystal display device illustrates. The data of the pixels defined by the even-numbered data lines D2, D4, D6 . . . and the scan lines G2, G3 . . . $G_m$ are held one scanning time of scan line. For example, at the scanning of the second scan line, originally, the data line D2 should transfer the video data $G_{21}$ of the pixel of the first display unit defined by the scan line G2 and the data line D2. However, according to the present invention, the data line D2 transfers the video data $G_{11}$ of the pixel of the first display unit defined by the scan line G1 and the data line D2. The data lines Dl and D3 still transfer the video data $R_{21}$ and $B_{21}$ of the pixels of the first display unit defined by the scan line G2 and the data line D1, D3. Similarly, the data line D4 should transfer the video data $R_{22}$ of the pixel of the second display unit defined by the scan line G2 and the data line D4, originally. However, according to the present invention, the data line D4 transfers the video data $R_{12}$ of the pixel of the second display unit defined by the scan line G1 and the data line D4. The data line D5 transfers the video data $G_{22}$ of the pixel of the second display unit defined by the scan line G2 and the data line D5. The data line D6 transfers the video data $B_{12}$ of the pixel of the second display unit defined by the scan line G2 and the data line D6. The rest may be deduced by analogy.

According to the present invention, the data sent out from the row-inversion driver are changed to the patern as shown in FIG. 12. Moreover, the changed data are applied to the liquid crystal display structure of the present invention as shown in FIG. 5. According to the liquid crystal display structure of FIG. 5, the thin film transistors formed at the intersections of each scan line and the data lines (D1, D2, D3, . . . Dn) are arranged in alternatingly up-down form along connected scan line. Therefore, when using the row-inversion driver to drive the thin-film transistor liquid crystal display device of the present invention, the data is stored in the pixel regions in an alternatingly up-down form. Therefore, a correct image can be displayed in the liquid crystal display as shown in FIG. 13. Additionally, the video data as shown in FIG. 13 are driven by the row-inversion method. However, a display result of dot-inversion driving method as shown in FIG. 11 is displayed.

Accordingly, a display result of the dot-inversion driving method using a row-inversion driving method is obtained. The present invention can reduce the power consumption and flicker phenomenon coming from the dot-inversion method.

As is understood by a person skilled in the art, the foregoing descriptions of the preferred embodiment of the present invention are an illustration of the present invention rather than a limitation thereof. Various modifications and similar arrangements are included within the spirit and scope of the appended claims. The scope of the claims should be accorded to the broadest interpretation so as to encompass all such modifications and similar structures. While a preferred embodiment of the invention has been illustrated and described, it will be appreciated that various changes can be made therein without departing from the spirit and scope of the invention.

What is claimed is:

1. A liquid crystal display driving method, wherein said liquid crystal display comprises a first scan line and a second scan line adjacent to said first scan line, a first data line and a second data line adjacent to said first data line respectively connected to a data line driver, a row of transistors having a first and a second transistor respectively located in a first pixel and a second pixel, wherein gate electrodes of said first and second transistors are respectively connected to said first scan line and said second scan line, and the drain electrodes of said first and second transistors are respectively coupled to said first data line and said second data line, the method comprising:

generating a first data signal and second data signal from said data line driver respectively for said first pixel and second pixel at a first time;

selecting said first scan line and transferring said first data signal to said first pixel via said first data line and holding said second data signal at a second time, wherein said first data signal is made to have a first polarity, and said first time is prior to said second time; and selecting said second scan line and transferring said second data signal to said second pixel via said second data line at a third time, wherein said second data signal is made to have a second polarity opposing to said first polarity, and said second time is prior to said third time.

2. The liquid crystal display driving method of claim 1, wherein said first data signal having said first polarity and said second data signal having said second polarity which are respectively transferred to said first and second pixels are respectively generated and sent out via said data line driver.

3. The liquid crystal display driving method of claim 1, wherein said first data line is an odd-numbered data line and said second data line is an even-numbered data line.

4. The liquid crystal display driving method of claim 1, wherein said first data line is an even-numbered data line and said second data line is an odd-numbered data line.

5. The liquid crystal display driving method of claim 1, wherein said scan lines are perpendicular to said data lines.

6. The liquid crystal display driving method of claim 1, wherein said first pixel and said second pixel are adjacent to each other and arranged in a same row.

7. The liquid crystal display driving method of claim 1, wherein said data line driver is a row-inversion driver and said liquid crystal display has a display result of dot-inversion.

8. The liquid crystal display driving method of claim 7, wherein said data line driver is a dot-inversion driver and said liquid crystal display has a display result of row-inversion.

* * * * *